United States Patent [19]

Farmer et al.

[11] Patent Number: 4,624,620

[45] **Date of Patent: * Nov. 25, 1986**

[54] FORKLIFT TRUCK PUSH-PULL SLIPSHEET HANDLER FOR FACILITATING CONVERSION OF TRUCK BETWEEN SLIPSHEET HANDLING AND PALLET HANDLING CAPABILITIES

[75] Inventors: Stanley E. Farmer, Corbett, Oreg.; Richard D. Seaberg, Vancouver, Wash.

[73] Assignee: Cascade Corporation, Portland, Oreg.

[ * ] Notice: The portion of the term of this patent subsequent to Nov. 13, 2001 has been disclaimed.

[21] Appl. No.: 741,727

[22] Filed: Jun. 6, 1985

Related U.S. Application Data

[62] Division of Ser. No. 634,694, Jul. 26, 1984, abandoned, which is a division of Ser. No. 493,141, May 9, 1983, Pat. No. 4,482,286.

[51] Int. Cl.[4] ..... B66F 9/14

[52] U.S. Cl. ..... 414/607; 414/661; 414/785

[58] Field of Search ..... 414/280, 497, 607, 608, 414/661, 785

[56] References Cited

U.S. PATENT DOCUMENTS

| | | | |
|---|---|---|---|
| 2,873,874 | 2/1959 | Best et al. | 414/461 X |
| 2,957,594 | 10/1960 | Brenneman . | |
| 3,180,513 | 4/1965 | Vander Wal . | |
| 3,310,189 | 3/1967 | Vander Wal . | |
| 3,640,414 | 2/1972 | Brudi . | |
| 3,809,264 | 5/1974 | Mayers . | |
| 3,885,692 | 5/1975 | Anderson . | |
| 4,065,012 | 12/1977 | Rocco . | |
| 4,274,794 | 6/1981 | Olson . | |
| 4,275,984 | 6/1981 | Lenertz . | |
| 4,300,867 | 11/1981 | Frees . | |
| 4,426,188 | 6/1984 | Wolf et al. . | |

FOREIGN PATENT DOCUMENTS 1781367 12/1970 Fed. Rep. of Germany .

OTHER PUBLICATIONS

Photograph of Yale Lift Truck Published By Y & T Research Div. (Undated).

Brochure-Cascade Quick-Mount Sideshifters, 5-1981.

Brochure-Cascade Load Pushes & Load Push/Pulls, 11-1982.

Photograph of Prior Art Push Assembly (Undated).

Schwind, G. "Slipsheets: A Technology Whose Time Has Come-But Not for Everyone", Material Handling Engineering, pp. 54-61, (Jul. 1980).

Brochure-Otis Elevator Co., Moto-Truc Custom Designed, Mar. 3, 1980.

Brochure-Brudi Equip., Inc., Brudi Broke Clamp (Undated).

Brochure-Brudi Equip., Inc., Rotating Reach Attachment (Undated).

Affidavit of Richard B. Inman (Dec. 1984) Exhibits 1-19.

*Primary Examiner*—Frank E. Werner

*Attorney, Agent, or Firm*—Chernoff, Vilhauer, McClung & Stenzel

[57] ABSTRACT

A push-pull slipsheet handler mountable on a standard hook-type lift truck carriage compatibly with load-handling forks mounted on the carriage. The slip-sheet handler comprises a push-pull assembly and split platen, both of which receive their vertical support from the load-supporting surfaces of the forks. Attachment of the push-pull assembly to the lower hook-type bar of the carriage provides resistance against fore-and-aft movement of the slipsheet handler. To convert the truck rapidly to a fork-type truck capable of handling standard rigid pallets rather than slipsheets, the platen may be quickly removed leaving the push-pull assembly in place or, alternatively, the push-pull assembly and platen may be removed as an integral unit.

9 Claims, 5 Drawing Figures

FORKLIFT TRUCK PUSH-PULL SLIPSHEET HANDLER FOR FACILITATING CONVERSION OF TRUCK BETWEEN SLIPSHEET HANDLING AND PALLET HANDLING CAPABILITIES

This application is a division of application Ser. No. 634,694, filed Jul. 26, 1984, now abanodoned, which is a division of application Ser. No. 493,141, filed May 9, 1983, now U.S. Pat. No. 4,482,286, issued Nov. 13, 1984.

BACKGROUND OF THE INVENTION

This invention relates to improvements in push-pull slipsheet handlers for forklift trucks.

Load push and push-pull devices have long been used on materials handling lift trucks. Prior to the popularity of slipsheets for handling loads, some forklift trucks were equipped with load push assemblies similar to that shown in Anderson, Jr., U.S. Pat. No. 3,885,692 to push loads off of standard load-handling forks. Later, when the use of thin, flexible slipsheets came into prominence, platens having a substantially greater load-supporting surface area than standard forks were used, such as those shown in Vander Wal U.S. Pat. Nos. 3,180,513 and 3,310,189, respectively.

Still later, combination push-pull and platen assemblies were developed, such as that shown in Frees U.S. Pat. No. 4,300,867, Brudi U.S. Pat. No. 3,640,414, or those currently manufactured by Cascade Corporation of Portland, Ore. under the designations 30C and 45C. Many of these have a two-piece, or split, platen so that the platen can, at least theoretically, be inserted into the end of a standard rigid wooden pallet if it becomes necessary to handle rigid pallets as well as slipsheets. Some units, such as the aforementioned Cascade 30C and 45C devices, have transversely adjustable split platen sections capable of handling slipsheet-supported loads of different widths. Such transversely-adjustable platen sections can be either manually adjusted or hydraulically adjusted.

Other types of units have been developed featuring platens mounted on the standard forks of a truck, but for different purposes such as the swivel-type platen shown in Brennaman U.S. Pat. No. 2,957,594.

A drawback of devices such as that shown in the aforementioned U.S. Pat. No. 3,885,692, wherein a push plate is used in connection with standard, relatively narrow, pallet-handling forks, is that the forks have insufficient surface area to support loads with underlying slipsheets. Conversely, early fork-mounted platens having sufficient surface area for slipsheet handling, such as those shown in U.S. Pat. Nos. 3,180,513 and 3,310,189, are likewise unsatisfactory because they have no slipsheet pulling capability and are therefore limited to engaging a slipsheet-supported load only by knifing their platens beneath the slipsheet.

Alternatively, more modern slipsheet-handling devices such as those shown in U.S. Pat. Nos. 4,300,867 and 3,640,414, or the aforementioned CASCADE 30C and 45C push-pull devices, although quite adequate for slipsheet handling, and although employing split platens and even transversely-adjustable split platens, are most difficult to use for handling rigid pallets. This is because the platens, in order to provide the necessary supporting surface area, are so wide that a lift truck driver cannot use them to engage a rigid pallet unless he approaches the end of the pallet virtually parallel to its longitudinal dimension. Any substantial angularity in the approach makes it impossible to insert the wide platens fully into the spaces provided in the pallet. Moreover, such platens cannot engage a standard rigid pallet along one of its longer sides as standard forks can. Standard rigid wooden pallets are 40 inches by 48 inches in size and are designed to be engaged on either their ends or longitudinal sides by trucks having standard load-handling forks.

The above-described difficulties of a truck with standard forks attempting to handle slipsheets and, conversely, the difficulties of a slipsheet handler attempting to handle standard rigid pallets, have led to severe equipment problems in the materials handling industry. Many shippers of goods prefer to use slipsheets rather than rigid pallets, primarily because slipsheets are expendable and do not have to be returned. On the other hand, most warehouse establishments which receive such shipments prefer to use rigid pallets to facilitate stacking and handling of loads. Accordingly such warehouses must have at least two different types of lift trucks on hand to handle loads received from shippers push-pull slipsheet-handling trucks to remove slipsheet-supported loads from highway trucks and transfer them to rigid pallets; and lift trucks equipped with standard load-handling forks to handle and stack the loads once they have been transferred to the rigid pallets.

This places an unduly high requirement, with respect to capital expenditures for materials handling equipment, on warehousemen and other receivers of goods, since the size of their lift truck fleets is effectively twice what it might otherwise be. Unfortunately, the lift trucks cannot be converted quickly or easily from slipsheet-handling capability to pallet-handling capability, and vice versa. This is because conversion to pallet handling requires not only removal of a complete push-pull assembly from the lift truck carriage, but also installation of standard forks, with the reverse procedure being necessary for the opposite conversion. There is insufficient time in the hectic scheduling of a warehousing operation to make such conversions repeatedly. Even where the push-pull assemblies are mounted compatibly with forks, as for example in the aforementioned U.S. Pat. Nos. 3,885,692 and 4,300,867, the push-pull assemblies are so reliant for their vertical support upon the lift-truck carriage or frame (rather than upon the upwardly-facing load-supporting surfaces of the forks) that they are substantially permanently mounted to the carriage or frame so as to be incapable of rapid attachment and detachment.

SUMMARY OF THE PRESENT INVENTION

The present invention is directed to push-pull slipsheet-handling apparatus which permits extremely rapid conversion of a lift truck between slipsheet-handling capability and pallet-handling capability.

As an added significant advantage, the push-pull slipsheet handler of the present invention is actually less expensive to manufacture than previous push-pull slipsheet handlers which did not provide such rapid convertibility of the lift truck.

The foregoing combination of advantages is achieved by making the push-pull assembly mountable on a standard lift truck hook-type carriage compatibly with standard pallet-handling forks, i.e. such that both may be supported on the lift truck carriage concurrently. Moreover, the push-pull assembly and its associated platen is vertically supported by the upper load-supporting surfaces of the forks, rather than by the lift truck carriage or frame as is the conventional practice. This permits the carriage-mounting structure of the push-pull assembly to be less permanent and less substantial than is normally required, thereby facilitating attachment and detachment of the push-pull slipsheet handler while also reducing the weight and expense thereof.

In addition, the push-pull slipsheet handler of the present invention is designed so as to permit convertibility of the lift truck by different alternative processes, thereby giving the operator utmost flexibility. By one conversion process, merely the platen of the slipsheet handler need be detached or attached, as the case may be, without any manipulation whatsoever of the push-pull assembly. In an alternative conversion process, the entire push-pull assembly and platen may be removed and installed as an integral unit. The first alternative, i.e. merely platen manipulation, is obviously quicker. However the latter alternative increases the load-handling capacity of counterbalanced lift trucks since the removal of the push-pull assembly permits the center of gravity of the load to be positioned more rearwardly relative to the truck.

For further versatility, despite the fact that the platen acts as part of the vertical support system for the push-pull assembly, the platen is nonetheless not only removable independently of the push-pull assembly but is also laterally adjustable with respect thereto.

Accordingly it is a principal objective of the present invention to provide a push-pull slipsheet handler of a type which improves the rapidity and facility of converting a lift truck between slipsheet handling and pallet-handling capability.

It is a further objective of the present invention to provide such rapidity and facility of lift truck conversion while also reducing the manufacturing cost of the slipsheet handler, by making such handler both compatible with, and supportable by the load-supporting surfaces of, a standard pair of pallet-handling forks mounted on the lift truck.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
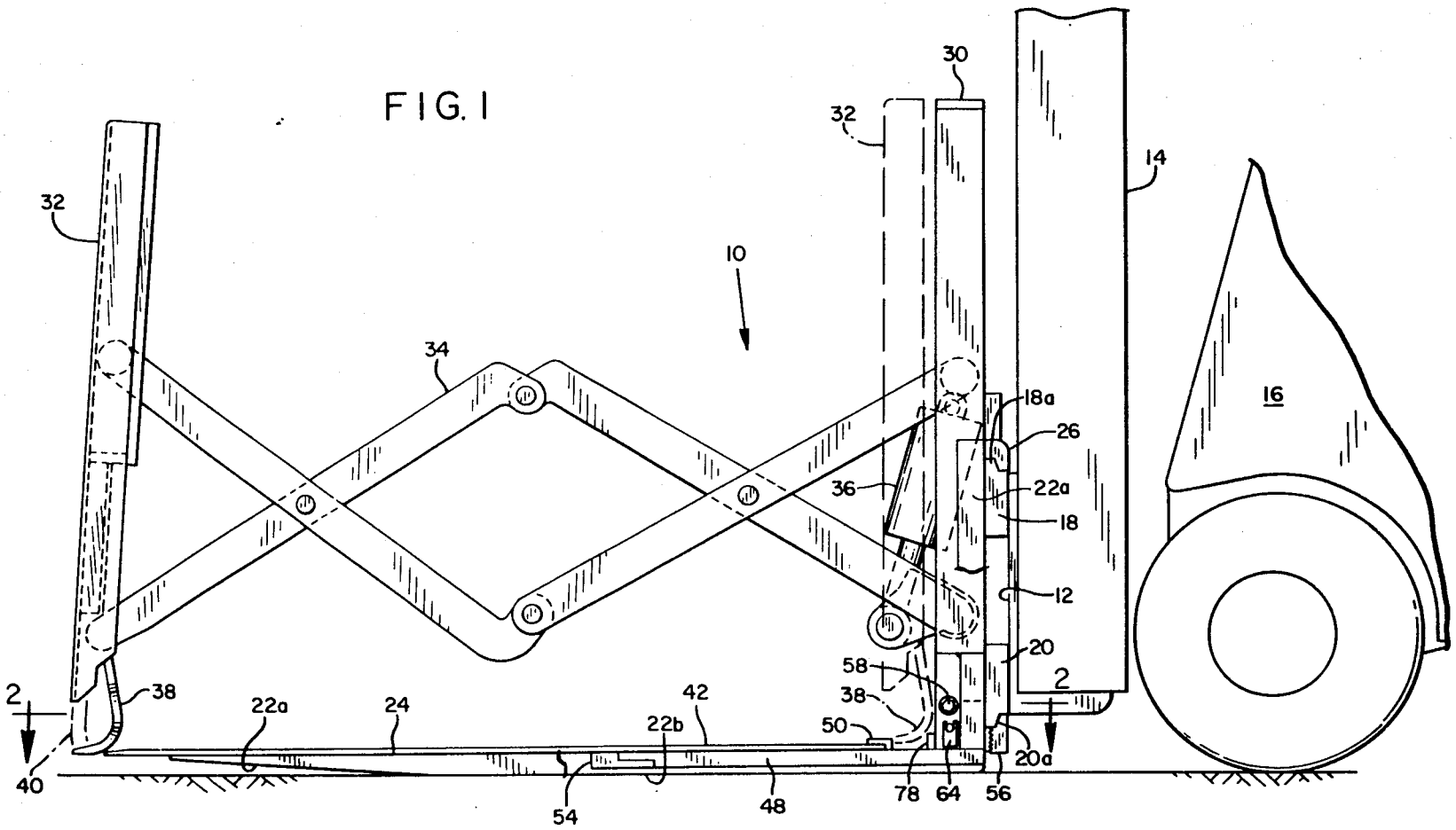
FIG. 1 is a side view of an exemplary embodiment of the push-pull slipsheet handler of the present invention shown mounted on a standard lift truck hook-type carriage together with a pair of load-handling forks, with a central portion of the nearest fork broken away to reveal the underlying structure of the slipsheet handler.

With reference to FIG. 1, an exemplary embodiment of the push-pull slipsheet handler of the present invention, indicated generally as 10, is shown mounted on a vertically-movable lift truck carriage 12 on a mast 14 of a lift truck 16. The carriage 12 has a pair of transverse mounting members 18 and 20 thereon to which are mounted a pair of forwardly-extending, transversely-spaced load-lifting forks **22*a* and 22*b* respectively, each having upwardly-facing load-supporting surfaces 24 thereon. Each fork 22*a*, 22*b* has an upstanding rear portion having a downwardly-opening hook such as 26 interlocked with an upwardly-protruding lip 18*a* on the upper transverse mounting member 18, together with an upwardly-opening hook 28 (FIGS. 2 and 4) interlocked with a downwardly-protruding lip 20*a* on the lower transverse mounting member 20. The upwardly and downwardly-protruding lips 18*a* and 20*a*** of the respective transverse mounting members may extend either continuously or discontinuously across the respective mounting member.

The push-pull slipsheet handler 10 includes a push-pull assembly composed of a rear frame 30, a forwardly-extensible and retractable push plate 32 and a conventional scissors linkage 34 powered by a transversely-spaced pair of selectively-extensible and retractable double-acting hydraulic cylinders 36. The push plate has a selectively openable and closable transverse jaw along the lower edge thereof including a fixed jaw member 38 and a cooperating vertically-extensible and retractable jaw member 40 under the control of a pair of vertically-oriented hydraulic cylinders 108 (FIG. 5) conventionally mounted on the push plate 32. In operation, the push plate 32 is extended as shown in FIG. 1 adjacent to a load lying on a slipsheet such that the fixed jaw 38 lies beneath a protruding tab of the slipsheet, and the movable jaw 40 is then extended to grasp the slipsheet tab between the jaws 38 and 40. Thereafter, by retraction of the cylinders 36, the scissors linkage 34 retracts the push plate 32 thereby pulling the slipsheet and its load onto a platen composed of twin platen sections 42 and 44 (FIG. 2), respectively, to be described more fully hereafter. To deposit the load, the cylinders 36 are extended, thereby extending the scissors linkage 34 and push plate 32 to push the load off of the platen.

Figure 2:
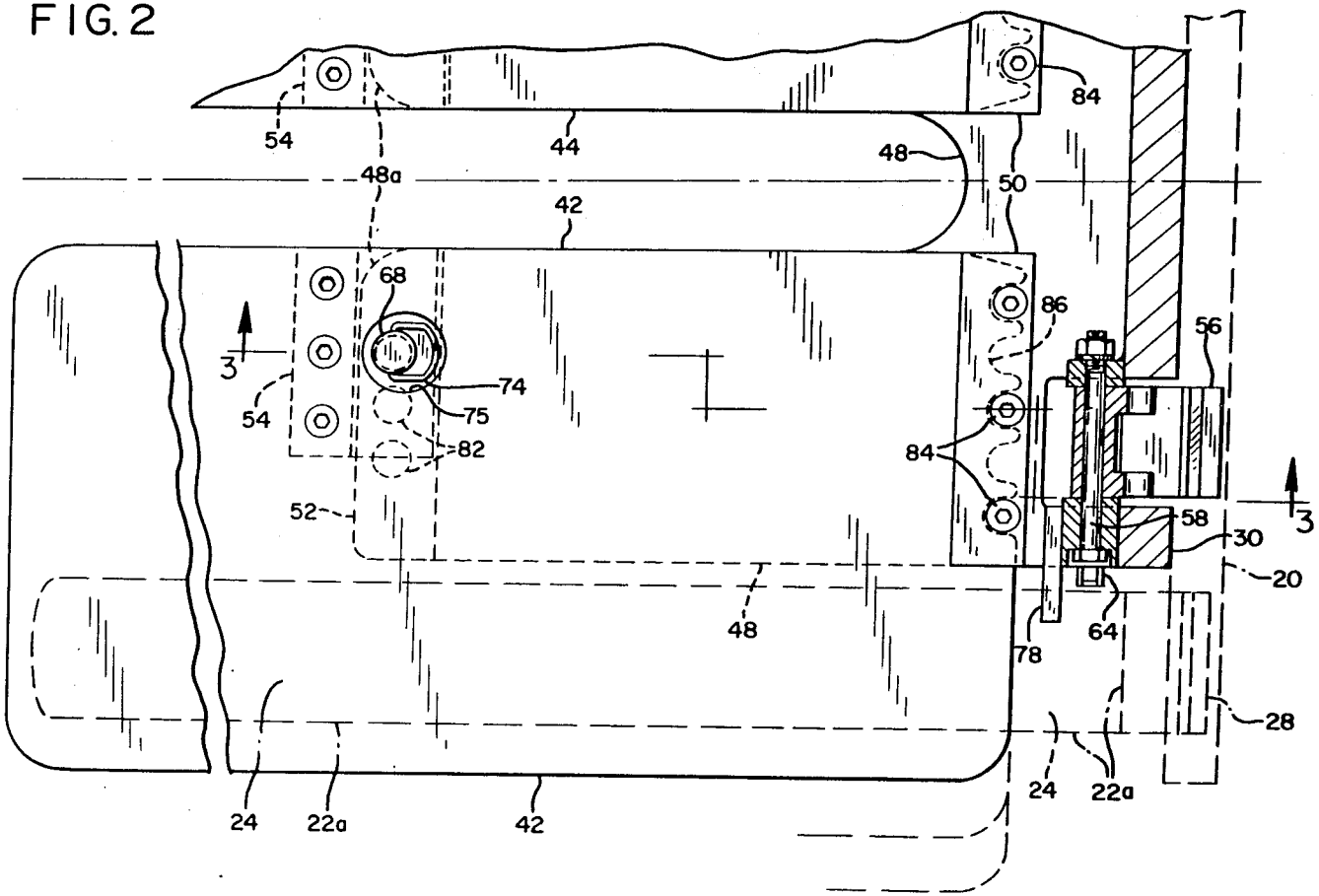
FIG. 2 is an extended top view of a portion of the slipsheet handler taken along line 2—2 of FIG. 1.

The platen sections 42 and 44 also form a portion of the push-pull slipsheet handler 10. As best seen in FIG. 2, they are of much greater surface area than that of the standard load-lifting forks **22*a* and 22*b***, respectively, to give adequate underlying support to the load since the slipsheet is made of a relatively thin, flexible material.

Figure 4:
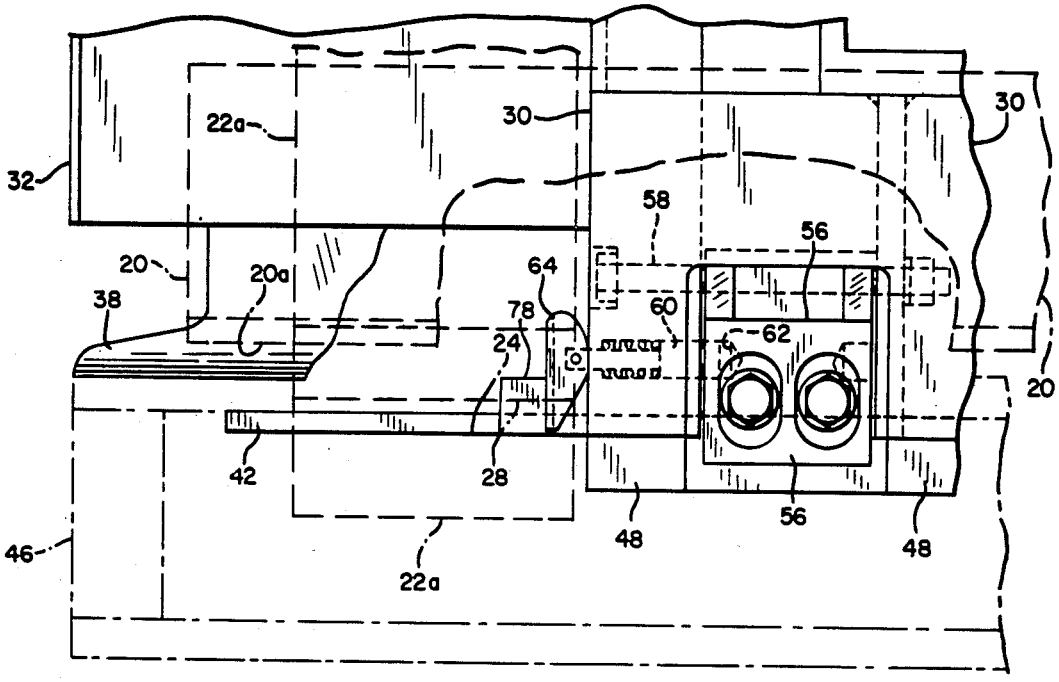
FIG. 4 is a rear view of a lower side portion of carriage lower transverse mounting member, a load-handling fork and an exemplary wooden pallet (all shown in phantom), wherein the platen of the slipsheet handler has been inserted longitudinally into the end of the pallet.

If it were desired that the lift truck 16 handle a load supported by a conventional rigid wooden pallet such as 46 as shown in phantom in FIG. 4, the large surface area of the platen sections 42 and 44 would be unnecessary because of the inherent rigidity of the pallet 46. In fact, although the platen sections 42 and 44 are narrow enough to be insertable into the end of a pallet 46 as shown in FIG. 4, their large size is a detriment for pallet handling purposes because the extreme width of the platen sections forces the lift truck operator to approach the end of the pallet substantially parallel to its longitudinal dimension, with little tolerance for any angular deviation in the approach. Accordingly, for handling rigid pallets such as 46, it is much more desirable from an operating point of view that the platen sections 42 and 44 be removed such that the relatively narrow load-lifting forks 22*a* and 22*b* can engage the pallet 46. The use of the forks 22*a* and 22*b* also enables the truck to engage a pallet such as 46 not only at its end but also, if desired, at one of its longitudinal sides through narrow fork pockets which are conventionally provided in such pallets, this latter maneuver being impossible with wide platen sections such as 42 and 44.

Moreover, when handling rigid pallets such as 46, the presence of the push-pull assembly may be a detriment even though the push plate 32 is completely retracted with respect to the rear frame 30. This is because the presence of the push plate and rear frame tends to limit the rearward extent to which a palletized load may be positioned on the forks, thereby limiting the extent to which the center of gravity of the load may be positioned in proximity to the front axle of the lift truck 16. This limitation in turn limits the load-carrying capacity of the truck 16 if it is of the counterbalanced type.

It is therefore highly desirable for the lift truck 16 to be rapidly convertible between slipsheet-handling capability and rigid pallet-handling capability. The slipsheet handler 10 of the present invention accomplishes this primarily by being mountable on the lift truck compatibly with the standard forks 22*a* and 22*b* so that the forks are always present and do not have to be mounted and demounted, and by vertically supporting both the push-pull assembly and the platen sections primarily on the upwardly-facing load-supporting surfaces 24 of the forks 22*a* and 22*b*.

Figure 3:
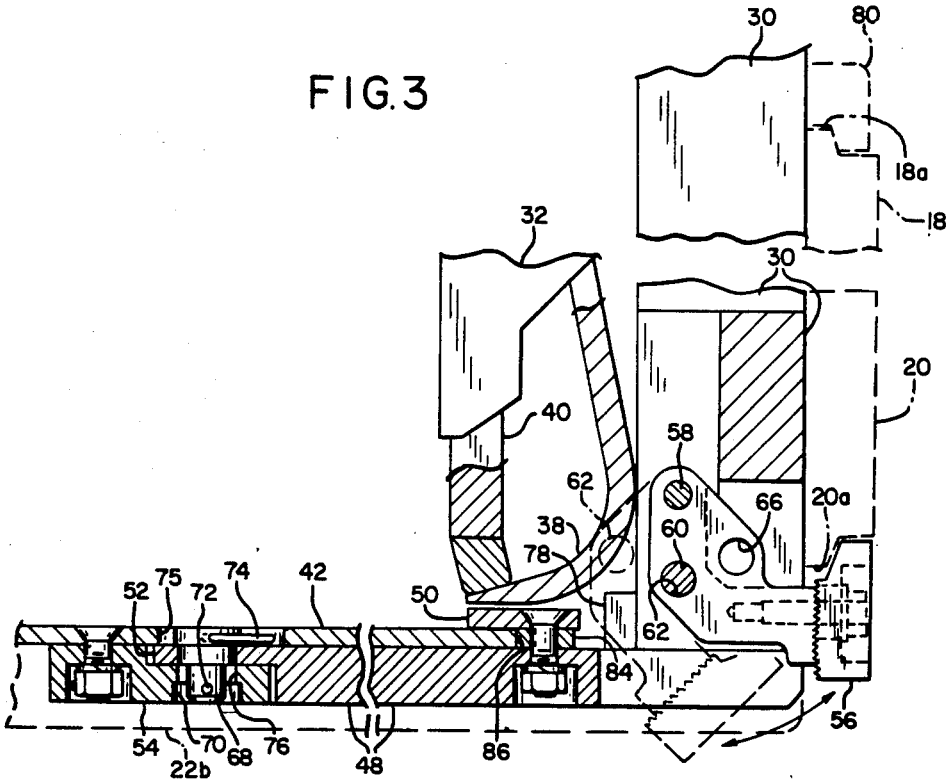
FIG. 3 is an enlarged, extended sectional view taken along line 3—3 of FIG. 2.

Turning now to the specific structure of the slipsheet handler 10, the rear frame 30 of the push-pull assembly has welded to its bottom edge a forwardly-protruding tongue 48 of substantial thickness and rigidity, but of less thickness than that of one of the forks 22*a* or 22*b*. With reference to FIGS. 2 and 3, the tongue has a pair of transversely-spaced rear interlocking members 50 and a pair of forward interlocking members 52 for detachably supportably connecting the tongue to each of the platen sections 42 and 44 respectively and suspending it therefrom. As can be seen in FIG. 3, the rear interlocking member 50 overlies the rear edge of the platen section 42, while the forward interlocking member 52 is inserted into a hanger 54 bolted to the underside of the platen section 42. A similar interlocking arrangement exists with respect to platen section 44. Thus, with the platen sections 42 and 44 overlying the forks 22*a* and 22*b* respectively and supported vertically by the upwardly-facing load-supporting surfaces 24 of the forks, the tongue 48 and thus the rear frame 30 of the push-pull assembly are likewise vertically-supported by the upwardly-facing load-supporting surfaces 24 of the forks.

Since vertical support for the entire slipsheet handler 10 is thus provided by the forks, there is need for very little connecting structure between the slipsheet handler 10 and the lift truck carriage 12. The only connection to the carriage 12 which is really necessary is a connection between the bottom of the frame 30 of the push-pull assembly and the lower transverse mounting member 20 of the lift truck carriage 12 in order to restrain the frame 30 against forward movement while the scissors linkage 34 is being retracted to pull a load onto the platen. This restraint is provided by a pair of transversely-spaced upwardly-opening hooks 56 (only one of which is shown) pivotally mounted to the frame 30 for rotation about a respective pivot bolt 58. When pivoted upwardly, as shown in FIG. 3, the hooks 56 detachably matingly engage the downwardly-protruding lip 20*a* of the carriage lower transverse mounting member 20 to prevent forward movement of the frame 30 relative to the lift truck carriage 12. The hooks 56 are retained in their upwardly-pivoted positions by insertion of a spring-biased locking pin 60 into a matching aperture 62 of the hook 56. Detachment of the hooks 56 from the carriage 12 to permit removal of the slipsheet handler 10 as an integral unit from the forks 22*a* and 22*b* is accomplished by retracting the locking pin 60 by twisting a cammed retractor member 64 and permitting the respective hooks 56 to pivot downwardly about the pivot bolt 58 as shown in phantom in FIG. 3.

A second aperture 66 is also provided in the hook 56 for insertion of the locking pin 60 to lock the hook in its downwardly-pivoted position, such position extending below the bottom of each fork as seen in FIG. 3. This enables each hook 56, by contact with the floor, to support the slipsheet handler 10 at a sufficiently elevated position to provide clearance for withdrawal of the forks by backing the lift truck away from the slipsheet handler when it is desired to demount the slipsheet handler as an integral unit. The same clearance facilitates insertion of the forks for remounting.

Because the slipsheet handler 10 is easily and rapidly mountable and demountable with respect to the lift truck 16 as an integral unit including the push-pull assembly and platen sections, it would be acceptable, and within the scope of the present invention, for the platen sections 42 and 44 to be permanently connected to the frame 30 by means of the tongue 48. However, to add a degree of flexibility to the process by which the lift truck 16 may be converted from slipsheet-handling to pallet-handling capability, and vice versa, the platen sections 42 and 44 are preferably detachable with respect to the tongue 48 and frame 30 by means of a quick-disconnect interlocking structure.

As seen in FIGS. 2 and 3, the forward interlocking member 52 of the tongue 48, and the mating hanger 54 on the underside of the platen 42, are interconnected by a quick-disconnect pin 68. When inserted as shown in FIG. 3, the pin 68 is prevented from withdrawal from aperture 70 of hanger 54 by a small locking stud 72 protruding therefrom. However the pin 68 may be withdrawn by lifting the bail 74 through an aperture 75 in the platen and rotating the pin 68 so that the stud 72 is aligned with a pair of slots 76 formed at the top of the aperture 70. The slots 76 provide clearance for the stud 72 such that the pin 68 may be withdrawn. Upon withdrawal of the pin 68, the respective platen section 42 may be detached from the tongue 48 by forward movement of the platen section until it clears the rear interlocking member 50 and front interlocking member 52 of the tongue 48. The other platen section 44 is removable in the same manner.

With platen sections 42 and 44 thus removed, rigid wooden pallets such as 46 (FIG. 4) can be easily handled in most applications. Although the tongue 48 remains in position, it protrudes forwardly only a relatively short distance and therefore does not interfere with the insertion of the forks into the pallet spaces, even during an angular approach to a pallet. The fact that the tongue 48 is bifurcated as shown in FIG. 2, with an elongate, centrally-located slot formed therethrough which is open and somewhat rounded at its forward extremity 48*a*, permits the full insertion of the forks into the end of a rigid pallet to the point where the pallet contacts the push-plate 32, the slot in the tongue 48 being wide enough to accept insertion of the pallet's central stringer. Although the push-plate 32 limits somewhat the rearward positioning of a palletized load on the forks, it should be noted that the placement of the unusually narrow frame 30 of the push-pull assembly between the forks 22*a* and 22*b*, so that the frame 30 overlaps the upstanding rear portions of the forks in a rearward direction as best seen in FIG. 2 rather than being positioned in front of the forks, minimizes the protrusion of the retracted pushplate 32 and thus maximizes the load carrying capacity of a counterbalanced truck with the push-pull assembly in place. Moreover, for relatively light palletized loads (relative to the capacity of the lift truck 16) pallets may even be engaged by the forks along their longitudinal sides by insertion of the forks up to the forward extremity of the tongue 48.

Because the platen sections 42 and 44 normally furnish vertical support for the tongue 48 and the attached frame 30 of the push-pull assembly, there should be some substitute means of vertical support if the platen sections are to be removed from the lift truck independently of the push-pull assembly and tongue 48. This substitute vertical support may be provided either by lugs such as 78 connected to the frame 30 and extending transversely therefrom so as to overlie the forks as best seen in FIG. 2 or, alternatively, by upper carriage hooks such as 80 (shown in phantom in FIG. 3) on the frame 30 for engaging the lip 18*a* of the upper carriage mounting member 18. Neither of these substitute support structures need be substantial because they are not relied upon for vertical support of the platen sections 42 and 44 nor, under operating circumstances, even for vertical support of the push-pull assembly.

Another feature providing added flexibility to the slipsheet handler is the provision of a transversely-adjustable connection between the platen sections 42 and 44 and the tongue 48. As seen in FIG. 2, the tongue 48 has multiple transversely-spaced apertures 82 extending through its forward interlocking member 52 for accepting insertion of the pin 68 at different transverse positions of the platen section 42 relative to the tongue 48. The transversely elongate nature of interlocking member 52 and hanger 54 permits transverse adjustment of the platen section relative to the tongue to provide alignment of the pin 68 with any of the apertures 82. Likewise, the rear interlocking member 50 of the tongue has a plurality of transversely-spaced positioning members 84 which mate with a plurality of transversely-spaced recesses 86 formed in the rear edge of the platen section 42. Thus by withdrawing the pin 68 and sliding the platen section forwardly with respect to the tongue, the platen section 42 may be transversely slidably adjusted on the forks relative to the tongue 48, primarily for the purpose of supporting wider loads on slipsheets. Similar transverse adjustment structure exists with respect to the other platen section 44.

In view of the fact that the platen sections are detachable from the tongue 48, it is convenient also to provide them in different interchangeable widths for accommodating different-sized loads.

Figure 5:
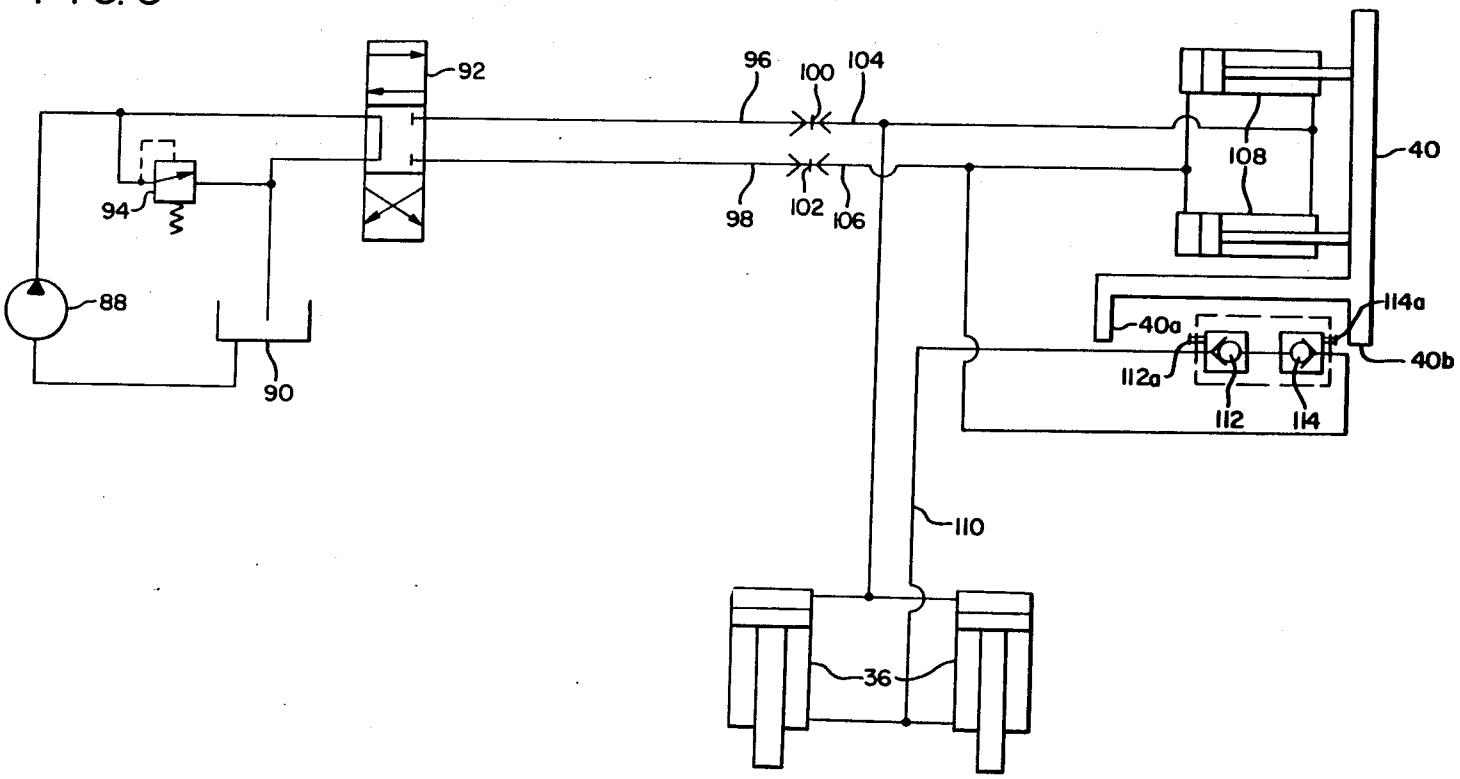
FIG. 5 is a schematic diagram of the hydraulic circuit of the slipsheet handler.

FIG. 5 is a schematic diagram of the hydraulic circuit of the slipsheet handler 10. A pump 88 draws fluid from a reservoir 90 and feeds it to an operator-controlled selector valve 92. These components, together with a standard relief valve 94, are mounted on the lift truck 16 and are connected by a pair of quick-disconnect line couplers 100 and 102 to hydraulic lines 104 and 106 respectively of the slipsheet handler. The couplers 100 and 102, respectively, are disconnected whenever the slipsheet handler 10 is removed as an integral unit, i.e., including both platen and push-pull assembly.

The hydraulic actuating system of the slipsheet handler 10 is conventional except with respect to the manner in which the hydraulic cylinders 108 which selectively extend and retract the jaw member 40 are sequenced with respect to the cylinders 36. Such sequencing is necessary to ensure that the jaw member 40 is extended into engagement with the fixed jaw member 38 prior to any retraction of the cylinders 36 to retract the scissors linkage 34. Without such sequencing, it is possible that a slipsheet will not be grasped by the jaw 40 prior to the retraction of the scissors linkage to draw the load onto the platen.

Since the fluid line, such as 106 in FIG. 5, which extends the jaw-actuating cylinders 108 and retracts the scissors-actuating cylinders 36 is usually connected to these two sets of cylinders in parallel as shown in FIG. 5, it has often been necessary that some type of valve be interposed in the retraction line 110 of cylinders 36 to delay their retraction until the cylinders 108 have been fully extended. In the past, such valve has taken two different forms. One form of the valve has been a simple relief valve which remains closed until line pressure reaches a predetermined level indicating full extension of the cylinders 108, at which time the valve opens and permits pressurized fluid to be fed to cylinders 36 to retract them. A second form of the valve has been a time delay type, i.e., where the valve opens to permit retracting pressure to cylinders 36 only in response to line pressure sensed through a restricted pilot line.

Both of these prior forms of valves, however, have had serious drawbacks. The pressure-relief form of valve can be triggered prematurely under cold ambient conditions by high line pressures resulting from high hydraulic fluid viscosity or, alternatively, by high pressures due to the operator's rapid actuation of the selector valve 92. On the other hand, the time delay form of valve can cause too long a delay when operating under cold conditions with high fluid viscosity.

These same two types of valves have in the past also been used to control an opposite sequencing between the cylinders 108 and cylinders 36 respectively. In this second type of sequencing, the objective is to ensure that the cylinders 108 have retracted the jaw 40 prior to extension of the cylinders 36 to extend the scissors linkage. This ensures that the jaw 40 is open in preparation for an approach to a slipsheet-supported load and is particularly important if, in the process of pulling a load onto a platen, the slipsheet slips from the grasp of the jaw 40 and the scissors linkage has to be extended to regain contact with the slipsheet.

In the present invention, the two above-mentioned forms of valves previously used to accomplish the described sequencing operations are replaced by check valves mechanically responsive to the actual position of the jaw 40. For example, when selector valve 92 is actuated to introduce pressurized fluid to line 106 to extend the cylinders 108 and jaw 40 and retract the cylinders 36 and the scissors linkage 34, the jaw 40 is extended first while the cylinders 36 are prevented by check valve 112 from receiving retracting fluid through line 110 until jaw 40 has been extended into contact with jaw 38, at which time a contact member 40*a* engages a valve-unseating member 112a which opens the valve and permits retracting fluid to pass through line 110. Conversely, if the selector valve 92 is actuated to deliver pressurized fluid through line 104 to retract the cylinders 108 and jaw 40 and extend the cylinders 36 and the scissors linkage 34, an opposite check valve 114 prevents any exhaust of fluid from cylinders 36 while cylinders 108 are retracting the jaw 40, until such time as the jaw 40 is fully retracted at which time contact member **40*b* engages a valve-unseating member 114*a* which opens the valve to permit the exhaust of fluid from cylinders 36 through line 110, thereby permitting extension of the cylinders 36 and thus extension of the scissors linkage 34. It will be appreciated that this form of sequencing valve arrangement will not permit premature extension or retraction of the cylinders 36 under conditions which cause excessive line pressure, nor will it cause excessively retarded actuation of the cylinders 36** under cold, high-viscosity conditions.

It should also be noted that it is within the scope of the invention for valves 112 and 114, rather than being interposed in line 110, alternatively to be interposed in the opposite line leading to cylinders 36 such that valve 112 prevents the exhaust of fluid from cylinders 36 during extension of cylinders 108 until engaged by contact member **40*a*. In such case valve 114 would prevent the supply of fluid to cylinders 36 during retraction of cylinders 108 until engaged by contact member 40*b***.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A push-pull slipsheet handler adaped for rapid mounting and demounting with respect to a pair of transversely-spaced load-lifting forks having upwardly-facing load-supporting surfaces thereon, said forks being mounted on a vertically-movable lift truck carriage, said push-pull slipsheet handler comprising:

(a) a push-pull assembly including an upright frame, a push plate, power means mounted on said frame for selectively extending and retracting said push plate with respect respect to said frame and selectively openable and closable jaw means on said push plate for gripping a slipsheet;

(b) platen means overlying said forks for supporting a slipsheet thereon, said platen means having a downwardly-facing surface engaging said upwardly-facing load-supporting surfaces of said forks so as to be vertically supported by said upwardly-facing load-supporting surfaces, said forks being supported vertically by said carriage;

(c) means for connectine said frame of said push-pull assembly to said platen means for mounting and demounting of said frame and platen means as a unit with respect to said forks and carriage;

(d) said frame of said push-pull assembly having a top and a bottom and said forks having upstanding portions extending above the bottom of said frame, said frame being positioned in substantially coextensive and parallel overlapping relationship in a rearward direction with respect to said upstanding portions of said forks and said platen means having a transverse rear edge located forwardly of said upstanding portions of said forks when said frame and platen means are mounted with respect to said forks and carriage; and (e) means supportably suspended from said platen means and interconnected between said downwardly-facing surface of said platen means and said frame of said push-pull assembly for vertically supporting at least the majority of the weight of said frame by applying said weight of said frame to said platen means by suspension from below said downwardly-facing surface.

2. The apparatus of claim 1 wherein said frame includes a portion extending vertically above said platen means, said rear edge of said platen means being located forwardly of the bottom of said portion of said frame.

3. A push-pull slipsheet handler adapted for rapid mounting and demounting with respect to a pair of transversely-spaced load-lifting forks having upwardly-facing load-supporting surface thereon, said forks being mounted on a vertically-movable lift truck carrige, said push-pull slipsheet handler comprising:

(a) a push-pull assembly including a frame, a push plate, power means for selectively extending and retracting said push plate with respect to said frame and selectively openable and closable jaw means on said push plate for gripping a slipsheet;

(b) platen means overlying said forks and extending transversely therefrom for supporting a slipsheet thereon, said platen means engaging said upwardly-facing load-supporting surfaces of said forks so as to be vertically-supported by said upwardly-facing load-supporting surface, said forks being supported vertically by said carriage;

(c) means for connecting said frame of said push-pull assembly to said platen means for mounting and demounting of said frame and platen means as a unit with respect to said forks and carriage;

(d) rapidly disconnectable means detechably interconnecting said frame of said push-pull assembly and said platen means with said forks and carriage for resisting forward movement of said frame and platen means, relative to said forks and carriage, during retraction of said push plate; and (e) a member movably mounted with respect to said frame and platen means so as to be selectively movable between a raised position and a lowered position, said movable member is said lowered position extending below the bottoms of said forks, and means for selectively locking said movable member against movement with respect to said frame and platen means in said lowered position for supporting said frame and platen means in an elevated position by contact with an underlying supporting surface when said frame and platen means are demounted with respect to said forks and carriage, further including means for selectively locking said movable member against movement with respect to said frame and platen means in said raised position such that said movable member is substantially above the bottoms of said forks.

4. Apparatus of claim 3 wherein said movable member includes said rapidly disconnectable means, said movable member interconnecting said frame of said push-pull assembly and said platen means with said forks and carriage when in said raised position and disconnecting said frame and platen means from said forks and carriage when in said lowered position.

5. A push-pull slipsheet handler adapted for rapid mounting and demounting with respect to a pair of transversely-spaced load-lifting forks having upwardly-facing load-supporting surfaces thereon, said forks being mounted on a vertically-movable lift truck carriage, said push-pull slipsheet handler comprising:

(a) a push-pull assembly including an upright frame, a push plate, power means mounted on said frame for selectively extending and retractinc said push plate with respect to said frame and selectively openable and closable jaw means on said push plate for gripping a slipsheet;

(b) platen means overlying said forks for supporting a slipsheet thereon, said platen means engaging said upwardly-facing load-supporting surfaces of said forks so as to be vertically supported by said upwardly-facing load-supporting surfaces, said forks being supoorted vertically by said carriage;

(c) said frame of said push-pull assembly having a top and a bottom and said forks having upstanding portions extending above the bottom of said frame, said frame being positioned in substantially coextensive and parallel overlapping relationship in a rearward direction with respect to said upstanding portions of said forks and said platen means having a transverse rear edge located forwardly of said upstanding portions of said forks when said frame and platen means are mounted with respect to said forks and carriage; and (d) interconnecting means connecting said frame of said push-pull assembly to said platen means for mounting and demounting of said frame and platen means as a unit with respect to said forks and carriage, said interconnecting means extending forwardly beneath said platen means, and extending rearwardly beyond said transverse rear edge of said platen means to a position in overlapping relationship in a rearward direction with respect to said upstanding portions of said forks.

6. The apparatus of claim 1 wherein said means supportably suspended from said platen means extends forwardly beneath said platen means and rearwardly beyond said transverse rear edge of said platen means.

7. The apparatus of claim 5, further including means detachably connecting said frame of said push-pull assembly to said forks and carriage for vertically supporting said frame of said push-pull assembly substantially independently of the vertical support of said platen means by said upwardly-facing load-supporting surfaces of said forks.

8. The apparatus of claim 5 wherein said interconnecting means extends downwardly substantially to no greater an extent than said forks.

9. The apparatus of claim 5 wherein said platen means comprises a pair of elongate, transversely-spaced, forwardly-extending plates overlying said forks and extending transversely therefrom for supporting a slipsheet thereon, said plates having respective downwardly-facing surfaces engaging said upwardly-facing load-supporting surfaces of said forks so as to be vertically supported by said upwardly-facing load-supporting surfaces, and a member joining said pair of plates rigidly together, said member spanning the transverse space between said plates and having a pair of forwardly-extending, elongate rigid portions rigidly attached to each other and to said downwardly-facing surfaces of said plates, said elongate rigid portions defining an elongate slot extending forwardly between said portions in a location corresponding to the transverse space between said pair of plates, said slot being open at its forward extremity.

* * * * *